United States Patent [19]

Carpenter

[11] Patent Number: 4,941,295

[45] Date of Patent: Jul. 17, 1990

[54] ABRASIVE ELEVATING APPARATUS FOR BLAST MACHINES AND METHOD OF USING

[75] Inventor: James H. Carpenter, Hagerstown, Md.

[73] Assignee: Pangborn Corporation, Hagerstown, Md.

[21] Appl. No.: 337,158

[22] Filed: Apr. 12, 1989

[51] Int. Cl.[5] ..... B24C 9/00

[52] U.S. Cl. ..... 51/425; 51/423; 51/436; 51/319; 406/71; 406/100

[58] Field of Search ..... 51/410, 422, 423, 424, 51/434, 436, 163.1, 164.1, 425, 319, 320; 406/71, 100, 101, 197

[56] References Cited

U.S. PATENT DOCUMENTS

| | | | |
|---|---|---|---|
| 2,666,942 | 1/1954 | Coleman | 51/422 |
| 2,930,657 | 3/1960 | Delzer | 406/71 X |
| 2,955,403 | 10/1960 | McKee | 406/71 X |
| 3,008,274 | 11/1961 | Welter | 51/423 |
| 3,716,947 | 2/1973 | Carpenter et al. | 51/422 X |
| 3,717,957 | 2/1973 | Walker | 51/422 |
| 3,977,128 | 8/1976 | Goff | 51/424 |
| 4,020,596 | 5/1977 | Bergh | 51/425 |
| 4,165,586 | 8/1979 | Fricke | 51/424 X |
| 4,222,205 | 9/1980 | Lake et al. | 51/425 X |
| 4,277,918 | 7/1981 | Bass | 51/423 X |
| 4,561,220 | 12/1985 | Carpenter et al. | 51/436 X |
| 4,757,648 | 7/1988 | Carpenter et al. | 51/423 |

FOREIGN PATENT DOCUMENTS

| | | | |
|---|---|---|---|
| 1539571 | 1/1979 | United Kingdom | 51/424 |

*Primary Examiner*—Robert P. Olszewski

*Attorney, Agent, or Firm*—Charles E. Brown; Charles A. Brown

[57] ABSTRACT

This relates to an elevating system for elevating used abrasive particles in a blast machine arrangement so that theused abrasive particles may be returned to an associated blast head for reuse. Basically speaking, the abrasive particle elevating system includes a throwing wheel mounted within a housing to which there is coupled an elevating casing. These two elements replace the normal and more expensive installation a bucket type conveyor for delivering the used abrasive particles and materials removed thereby to an elevated separator associated with a supply bin for abrasive particles for an elevated blast head. The throwing wheel may be of a varied construction and there may be at least two throwing wheels in tandem to provide for a greater elevating height or horizontal distance. If desired, a second throwing wheel may throw the used abrasive particles over the roof of a blast room so that there may be a blast head on two opposite walls of the blast room. Suitable gate arrangements may be provided so as to assure a full supply of used abrasive particles to the throwing wheel so as to prevent choking due to dribbling.

14 Claims, 2 Drawing Sheets

FIG. 1
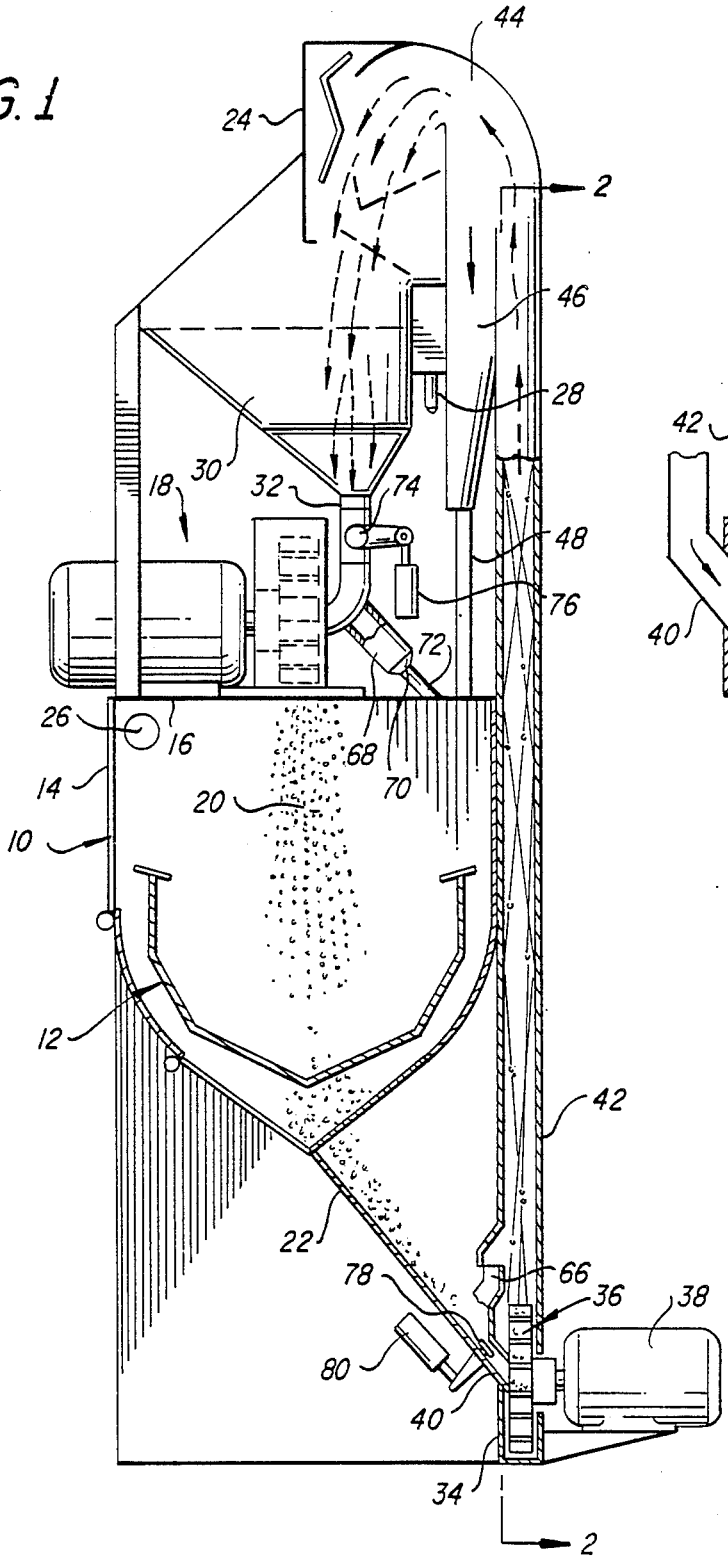
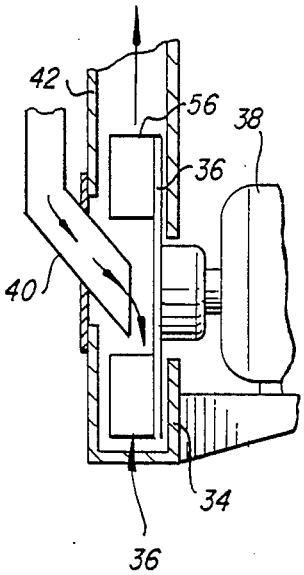
FIG. 3

ABRASIVE ELEVATING APPARATUS FOR BLAST MACHINES AND METHOD OF USING

BACKGROUND OF THE INVENTION

In the common usage or a blast machine, abrasive particles are directed against an article to be cleansed by a blast wheel. The spent abrasive particles and material removed from the articles then fall into a hopper with the abrasive particles being cleansed of the removed material and then being delivered back to the blast wheel. Since the blast wheel is elevated relative to the hopper and since there must be a constant supply of the abrasive particles for the blast wheel, it is necessary that there be an elevated storage bin for the abrasive particles. Further, it is preferred that there be an elevated abrasive particle cleaning apparatus for removing from the abrasive particles the removed material.

OBJECTS OF THE INVENTION

Practically all blast machines utilize bucket elevators to return the spent abrasive back to the storage bin for reuse. The bucket elevator is ideally suited for such machines in that the bucket elevators can elevate efficiently large quantities of abrasives to almost any height. However, in a small inexpensive blast machine, the elevator cost can be a significant percentage of the total machine cost. This invention relates to a simple spent abrasive elevator for elevating the spent abrasive to a reasonable height and which costs less than an equivalent capacity bucket elevator. Most particularly, this invention relates to an elevator which utilizes as the abrasive particle elevating means a propelling wheel or throwing wheel.

BRIEF DESCRIPTION OF THE DRAWINGS

With the above and other objects in view that will hereinafter appear, the nature of the invention will be more clearly understood by reference to the following detailed description, the appended claims, and the several views illustrated in the accompanying drawings.

FIG. 1 is a side elevational view with parts broken away and showing a section of a blast machine incorporating the spent abrasive particle elevating system which is the subject of this invention.

FIG. 3 is an enlarged fragmentary sectional view similar to the bottom right hand corner of FIG. 1 but wherein the throwing wheel has the used abrasive particles delivered directly to the vanes thereof.

DETAILED DESCRIPTION OF THE DRAWINGS

Figure 4:
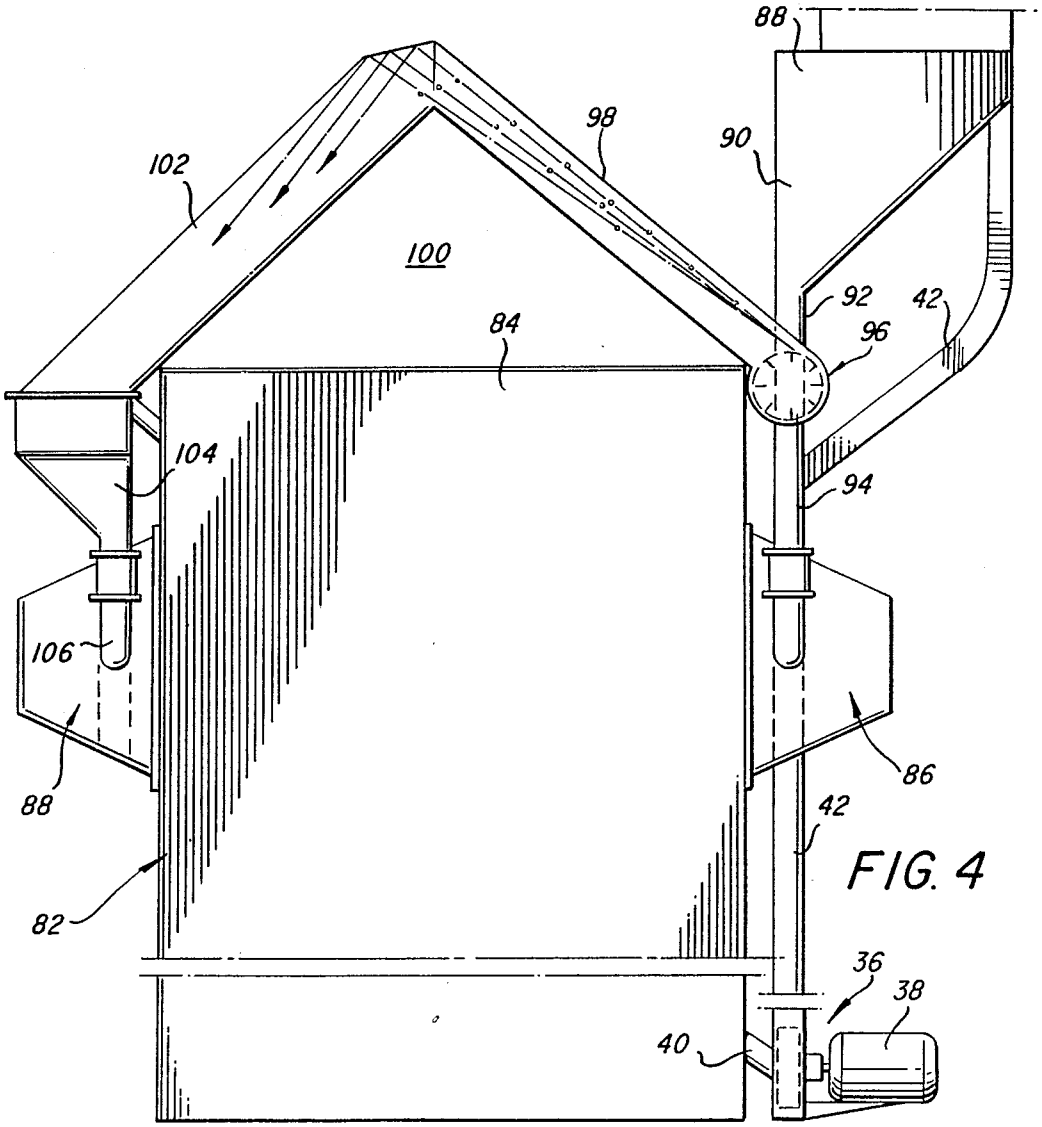
FIG. 4 is a schematic elevational view showing a modified form of the abrasive particle elevating system wherein there are blast apparatus at opposite sides of a blast machine, an intermediate part of the blast machine being broken away.

Referring now to FIG. 1, it will be seen that there is illustrated an embodiment of the invention associated with a blast machine of the rocker barrel type, the blast machine being generally identified by the numeral 10. The blast machine 10 includes a rocker barrel 12 which is mounted within a housing 14 to rotate about a generally horizontal axis. A top wall 16 of the housing 14 supports a blast wheel assembly, generally identified by the numeral 18, which delivers abrasive particles 20 at high velocity into the rocker barrel 12.

Spent abrasive particles 20 and material removed from articles carried by the rocker barrel 12 are collected in a lower hopper 22. These collected materials are normally elevated to the top of the blast machine 10 to a separator apparatus 24 to which air may be delivered by way of air inlet 26. The material removed from the spent abrasive is discharged through a discharge line 28 while the cleansed abrasive particles are directed into a supply bin 30 or directly to the wheel 18.

In the operation of a blast machine 10, the abrasive particles are delivered from the supply bin 30 through a supply chute 32 to the blast wheel 18.

This invention most particularly has to do with the elevating of the abrasive particles and removed material from the bottom of the hopper 22 to the separating apparatus 24.

In accordance with this invention, there is mounted at the bottom of the blast machine housing 14 a housing 34 for a throwing wheel 36 which is rotated at a selective speed by way of a motor 38. A delivery chute 40 delivers the used abrasive particles and removed material from the bottom of the hopper 22 into the center of the throwing wheel 36 to be thrown upwardly or elevated within an elevating casing 42 which is connected to the housing 34 as is best shown in FIG. 2.

The used abrasive particles are thrown up into the casing 42 with sufficient velocity for the abrasive particles to reach a curved upper portion 44 of the casing and through the separator 24 for delivery into the supply bin 30. However, some of the abrasive particles will not have sufficient velocity to reach the separating apparatus and will fall into a return casing 46 for flow down therethrough to the bottom of the hopper 22 and the associated delivery chute 40 through a return chute 48.

Figure 2:
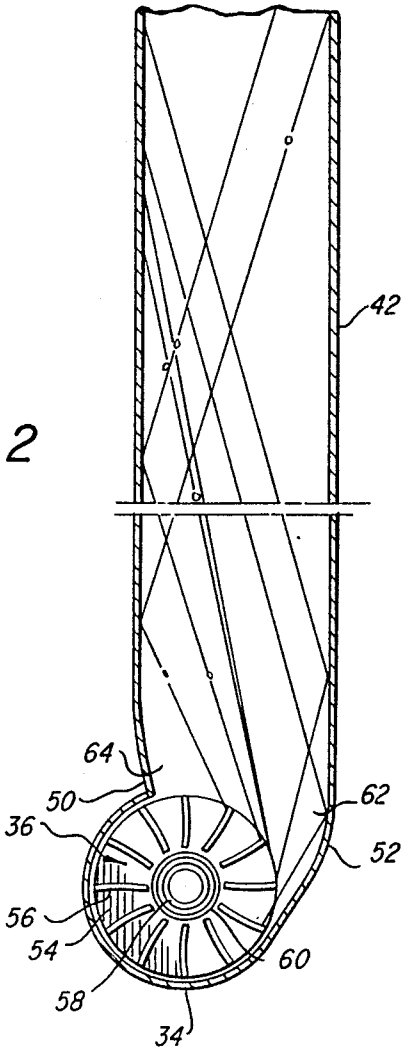
FIG. 2 is an enlarged fragmentary sectional view taken generally along the line 2—2 of FIG. 1 with an intermediate portion broken away showing the specific relationship of a throwing wheel and an elevating casing.

Referring now specifically to FIG. 2, it will be seen that the elevating casing 42 has a lower portion thereof coupled to the housing 34 and that the lower part of the casing 42 is selectively of a sloping or curved configuration as at 50, 52 to minimize the ricochet angle of abrasive particles against the walls of the elevating casing 42 At this time, it is pointed out that the illustrated throwing wheel 36 is generally of the same construction as a conventional blast wheel and includes a metal plate in the form of a runner head 54 which has removably mounted thereon a plurality of radiating vanes 56. While the vanes 56 have been illustrated as being of a curved configuration to obtain a maximum velocity of the thrown abrasive particles for a given small r.p.m., it is to be understood that the vanes 56 may be of a straight configuration.

In addition to the runnerhead 54 being rotated, a conventional blast wheel or head will include a rotating impeller 58 and an impeller casing 60.

As is shown in FIG. 2, the throwing wheel 36 delivers the abrasive particles in a fan shaped pattern or stream which includes a head stream portion 62 and a tail stream portion 64. By properly shaping the casing wall portions 50, 52, the abrasive particles are directed within the elevating casing 42 in a nearly vertical direction. As previously described, the curvature or sloping of the casing walls as at 50 and 52 provides a preferred ricochet pattern. At this point where the tail stream portion 64 engages the casing 42, the initial velocity of the abrasive particles being elevated is 76 F.P.S. and the angle of impact is 34°. With the co-efficient of restitution being 0.6, the theoretical rebound velocity is 68 F.P.S. On the other hand, if the impact angle is decreased the rebound velocity is higher. For example, at an impact angle of 20°, the rebound velocity is 73 F.P.S.

The elevating system is primarily for a smaller blast machine where the elevator height is relatively low. Testing has shown that with a 12 inch diameter throwing wheel directly driven with a 1200 r.p.m. motor, and with a 30,000#/Hr. flow the abrasive can be elevated to a height of approximately 12 feet with S-110 (0.011 diameter) metal shot. The abrasive particles can be elevated to the same 12 foot height turning the throwing wheel 36 at only 950 r.p.m. with S-230 shot and S-550 shot.

Wheel vane wear and wearing of the casing 34 must be considered. The abrasive velocity from the throwing wheel 36 at 1160 r.p.m. is approximately 76 F.P.S. Since the wear would be proportional to the impact energy on the casing and the friction energy on the vanes, the wear relationship would be approximately as follows:

If a standard throwing wheel of the size throwing shot at 240 F.P.S. (Standard Blasting Velocity) wore for 500 hours, this wheel should wear $(240/76)^2 \times 500 = 5000$ hours. Likewise, if the casing 34 is made of manganese steel, the wear should be ten times longer than a standard manganese wear plate being impacted at the same angles. Since the impact angles on the elevating casing 42 are generally less than 30°, the impact energy versus a standard 90° impact is about 5% of standard wear.

The simplicity and low cost of the elevating unit in relation to a bucket elevator will be apparent when one compares the two devices. A bucket elevator requires a head and tail pulley, pulley bearings, a belt with numerous buckets, a belt take-up device, belt guards, and also door openings and covers for splicing belts. The casing size for the elevator capacity that the device of this application is to replace is 9' ×2'7" whereas the elevating casing 42 should have a size on the order of 3"×1'0" and the only moving part is the throwing wheel 36 which is directly mounted on the shaft of the motor 38.

At this time it is pointed out that it is possible to utilize the runnerhead 54 and the vanes 56 without the impeller 58 and the impeller case 60 as is shown in FIG. 3. The delivery chute 40 may deliver the abrasive particles directly into the center portion of the throwing wheel 36, as is also shown in FIG. 3.

The system does not require air vent up the casing 42 to elevate steel abrasives. However, adding air flow is necessary to elevate and remove dust, very fine particles and sand if sand is in the mix. Since the casing is relatively small the amount of air required is also small. A suitable air line 66 may be provided for delivering air from the cabinet to the lower portion of the casing 42 as is shown in FIG. 1.

Testing has shown that the 12 inch diameter throwing wheel 36 at 1160 r.p.m. handles large flows (6000 to 38,000#/Hr.) without any problems. However, very low flows (below 2,500#/Hr.), with some abrasive sizes, require a higher r.p.m. to elevate material to a given height. The reason for this is thought to be that at very low flows, the wheel stream longitudinal pattern becomes very long resulting in a relatively high percentage of the flow not being thrown up the opening of the casing 42, but into the wheel housing 34, and when this flow exits the wheel housing 34 it does not have sufficient velocity to reach the separator 24 and thus falls back and interferes with the high velocity particles and thus causes the wheel to choke. With some machines this can be a problem if the flow at start-up and shut down dribbles at a low flow into the throwing wheel 36 for a period of time. In this case, the throwing wheel may choke before the normal flow reaches the throwing wheel. If the normal flow is high, the high flow will clear out the low flow choke condition. However, if the normal flow is relatively low, the choke condition may continue.

In order to solve the aforedescribed problem, the spout 32 is provided with a gate arrangement 74 which may be controlled by an extensible fluid motor 76. A similar gate arrangement 78 controlled by an extensible fluid motor 80 may be mounted in the delivery chute 40. At start-up, when the fluid motor 76 opens the gate assembly 74, coupled with a time delay utilizing a conventional timer, the gate assembly 78 opens. This time delay allows the gate assembly 78 to back up the start-up dribble to the throwing wheel 36 and not open until full flow is flowing to the hopper 22. Both gates will be closed at the same time to prevent a closing dribble from entering the throwing wheel 36.

Reference is now made to the schematic showing of FIG. 4 wherein there is illustrated a modified form of a blast machine generally identified by the numeral 82. The blast machine 82 includes a blast room 84 which has mounted on opposite sidewalls thereof blast units 86, 88. At one side of the housing 84 there is mounted an abrasive return system similar to that shown in FIG. 1. This system includes the delivery wheel 36 which receives used or spent abrasive particles from the delivery chute 40 and directs them into the elevating casing 42. The elevating casing 42 is coupled to a separator 88 which, in turn, is coupled to a storage bin 90.

The storage bin 90 is provided with two discharge chutes 92, 94. The discharge chute 94 leads to the blast head 86 in generally the same manner as disclosed in FIG. 1. The tube or chute 92 is coupled to a second throwing wheel 96 of the same general type as the throwing wheel 36. The housing of the throwing wheel 96 has coupled thereto another elevating casing 98 that elevates the abrasive particles over a roof 100 of the room into a casing extension 102 down through which the elevated abrasive particles will flow into another storage bin 104. The abrasive particles will then flow from the storage bin 104 through another supply chute 106 into the blast head 88. This modified form illustrates the ability of this device to convey material over a horizontal distance as well as vertically.

While the throwing wheel 36 has been specifically illustrated and described as a wheel wherein the vanes thereof act to throw the abrasive particles and the abrasive particles are delivered primarily axially to the center thereof, it is to be understood that the throwing wheel could have the abrasive particles delivered radially between outer ends of the vanes and be impelled by the vanes in a batting action.

Although only several preferred embodiments of the invention have been specifically illustrated and described herein, it is to be understood that minor variations may be made in the elevating system without departing from the spirit and scope of the invention as I claim: defined by the appended claims.

1. In a blast means where used abrasive particles are collected and recirculated, an abrasive particle return system, said system comprising supply means for supplying said blast means, receiving means for receiving returning abrasive particles, a rotating abrasive particle throwing wheel in the form of an impeller having vanes radiating from a center of the wheel, the center of the wheel being located below the receiving means, delivery means between said receiving means and said throwing wheel for delivering used abrasive particles to said throwing wheel, and an elevating casing directly connected to a discharge of said throwing wheel for directly receiving abrasive particles from said throwing wheel and delivering abrasive particles to said supply means.

2. An abrasive particle return system according to claim 1 together with an air assist opening into said casing above said throwing wheel discharge and in the direction of abrasive particle flow for elevating light weight material removed by the used abrasive particles.

3. An abrasive particle return system according to claim 1 together with a separator system at an upper end of said elevating casing for removing foreign matter from said abrasive particles, and a separate air assist opening into said casing above said throwing wheel discharge and in the direction of abrasive particle flow for elevating light weight material removed by the used abrasive particles to said separator system.

4. An abrasive particle return system according to claim 1 wherein said throwing wheel has a fan shaped discharge pattern wherein head and tail stream portions of said discharge pattern engage and ricochet off of opposite walls of said elevating casing.

5. An abrasive particle return system according to claim 1 wherein said throwing wheel has a fan shaped discharge pattern wherein head and tail stream portions of said discharge pattern engage and ricochet off of opposite walls of said elevating casing, and said walls are selectively sloped or curved to minimize ricochet angles.

6. An abrasive particle return system according to claim 1 wherein said delivery means delivers the used abrasive particles directly to ends of said vanes in a radial direction.

7. An abrasive particle return system according to claim 1 wherein said throwing wheel includes an inner impeller mounted within said impeller for distributing abrasive particles to said impeller.

8. An abrasive particle return system according to claim 1 wherein said throwing wheel includes an inner impeller and case mounted within said impeller for distributing abrasive particles to said impeller.

9. An abrasive particle return system according to claim 1 wherein said vanes are curved for greater abrasive elevating height of abrasive particles for a selected impeller r.p.m.

10. An abrasive particle return system according to claim 1 wherein said blast machine includes a blast room having a blast wheel at each side of said blast room, and said return system includes a second elevating casing extending over said blast room from said supply means, said second elevating casing being coupled to a second throwing wheel coupled to said supply means.

11. In a blast means where used abrasive particles are collected and recirculated, an abrasive particle return system, said system comprising supply means for supplying said blast means, receiving means for receiving returning abrasive particles, a rotating abrasive particle throwing wheel, delivery means between said receiving means and said throwing wheel for delivering used abrasive particles to said throwing wheel, and an elevating casing directly connected to a discharge of said throwing wheel for directly receiving abrasive particles from said throwing wheel and delivering abrasive particles to said supplying means, and return means between said elevating casing and said delivery means for returning abrasive particles from within said elevating casing which do not have sufficient velocity to reach said supply means.

12. In a blast means where used abrasive particles are collected and recirculated, an abrasive particle return system, said system comprising supply means for supplying said blast means, receiving means for receiving returning abrasive particles, a rotating abrasive particle throwing wheel, delivery means between said receiving means and said throwing wheel for delivering used abrasive particles to said throwing wheel, and an elevating casing directly connected to a discharge of said throwing wheel for directly receiving abrasive particles from said throwing wheel and delivering abrasive particles to said supplying means, and means for preventing undesired dribble flow to said throwing wheel.

13. An abrasive particle return system according to claim 12 wherein said means for preventing dribble flow includes a gate in said delivery chute.

14. A method of transporting particulate material, said method comprising the steps of providing a rotating wheel of the type including a plurality of vanes radiating from a center of the wheel, providing supply means located above the wheel center for supplying particulate material to said rotating wheel, utilizing said rotating wheel to impart velocity to said particulate material, guiding the moving particulate material to a preselected destination and utilizing the particulate material by discharging the particulate material from said preselected destination and returning the particulate material to said supply means.

* * * * *